US011072516B2

(12) United States Patent
Lou et al.

(10) Patent No.: US 11,072,516 B2
(45) Date of Patent: Jul. 27, 2021

(54) SAFETY APPARATUS FOR AN ESCALATOR AND AN ESCALATOR COMPRISING THE SAFETY APPARATUS

(71) Applicants: KONE ELEVATORS CO., LTD., Jiangsu (CN); KONE CORPORATION, Helsinki (FI)

(72) Inventors: Wenming Lou, Yushan Town Kunshan (CN); Bo Liu, Yushan Town Kunshan (CN); Wenke Deng, Yushan Town Kunshan (CN)

(73) Assignees: KONE ELEVATORS CO., LTD., Jiangsu (CN); KONE CORPORATION, Helsinki (FI)

( * ) Notice: Subject to any disclaimer, the term of this patent is extended or adjusted under 35 U.S.C. 154(b) by 0 days.

(21) Appl. No.: 16/748,047

(22) Filed: Jan. 21, 2020

(65) Prior Publication Data

US 2020/0239283 A1 Jul. 30, 2020

(30) Foreign Application Priority Data

Jan. 25, 2019 (CN) ..... 201910077240.4

(51) Int. Cl.
*B66B 29/00* (2006.01)
*B66B 21/04* (2006.01)
*B66B 29/02* (2006.01)

(52) U.S. Cl.
CPC ..... *B66B 29/005* (2013.01); *B66B 21/04* (2013.01); *B66B 29/02* (2013.01)

(58) Field of Classification Search
CPC ..... B66B 29/005; B66B 21/04; B66B 29/02
USPC ..... 198/321
See application file for complete search history.

(56) References Cited

U.S. PATENT DOCUMENTS

| | | | | |
|---|---|---|---|---|
| 10,843,903 | B2 * | 11/2020 | Turek | B66B 21/04 |
| 10,858,221 | B2 * | 12/2020 | Turek | B66B 23/02 |
| 2016/0368741 | A1 * | 12/2016 | Blondiau | B66B 21/025 |
| 2019/0265015 | A1 * | 8/2019 | Michiwaki | G01L 1/22 |
| 2020/0173645 | A1 * | 6/2020 | Singh | F21V 33/0088 |
| 2020/0385238 | A1 * | 12/2020 | Turek | B66B 23/028 |

OTHER PUBLICATIONS

Extended European Search Report, dated Jun. 24, 2020, for European Application No. 20153378.3.

* cited by examiner

*Primary Examiner* — Gene O Crawford
*Assistant Examiner* — Lester III Rushin
(74) *Attorney, Agent, or Firm* — Birch, Stewart, Kolasch & Birch, LLP

(57) ABSTRACT

Disclosed are a safety apparatus for an escalator and an escalator. The safety apparatus is disposed on the skirt of the escalator, the safety apparatus includes a one-piece profile which comprises a rear wall, an upper portion at an upper end of the rear wall, and a lower portion at a lower end of the rear wall, wherein a plurality of sensor holes are provided on the rear wall, and the safety apparatus further comprises an illumination device, a skirt brush, and a plurality of photoelectric sensors, wherein the illumination device is disposed on the profile and emits illumination light toward the step side, wherein the skirt brush is disposed on the lower portion, and wherein the plurality of photoelectric sensors are mounted to be respectively aligned with the plurality of sensor holes so as to emit and/or receive optical signals through the plurality of sensor holes.

15 Claims, 4 Drawing Sheets

SAFETY APPARATUS FOR AN ESCALATOR AND AN ESCALATOR COMPRISING THE SAFETY APPARATUS

TECHNICAL FIELD

The present disclosure relates to a safety apparatus for an escalator and an escalator comprising such safety apparatus.

BACKGROUND

The skirt of the escalator is located on both sides of the escalator, and mainly plays a role of safety and beauty. Due to the special nature of the working structure, there must be a gap of different size between the skirt and the steps, and the gap is likely to cause accidents, such as the passengers' shoes, pants, and even the fingers of children being clamped. Therefore, a skirt brush, that is, a skirt anti-pinch device, is usually installed on the skirt of the escalator, which can prevent foreign objects from entering the gap between the skirt and the steps; or an illumination device is installed on the skirt of the escalator, which can alert passengers to stay away from the gap. In addition, for example, during the maintenance of the escalator, the operator sets the escalator to a disabled state. Considering safety factors, it is necessary to ensure that the escalator remains in a disabled state when someone or an object enters the escalator. Generally, sensors are installed on the skirt to detect whether people or objects enter the escalator.

The escalator generally comprises an upper horizontal section, a lower horizontal section, and an inclined section, and at the curved section between the horizontal section and the inclined section, the skirt of the escalator is bent. Due to the limitation of the manufacturing materials and processing technology of the skirt, the height of the skirt in the height direction of the escalator should not be too large, otherwise the mechanical strength of the skirt is not enough, so it is prone to problems such as fracture and it even makes it is impossible to form. Therefore, the space for installing additional devices on the skirt is limited. In addition, installing additional devices on the skirt requires processing a profile with a mounting groove, and placing additional devices along the curved section of the skirt usually requires a curved profile. Due to the limitation of the material of the profile and the processing technology, the height of the profile in the height direction of the escalator should not be too large, otherwise the profile with the mounting groove will be deformed at the curved section. This further increases the difficulty of installing additional devices on the skirt. Considering the installation space limitation and aesthetic factors, in the prior art, usually only a skirt brush is installed on the skirt, or only sensors are installed on the skirt, or both the skirt brush and the light strip are installed on the skirt, or both the skirt brush and the sensors are installed on the skirt. There is no technology to install the skirt brush, the illumination device and the sensors on the skirt.

SUMMARY

Therefore, an object of the present disclosure is to provide a safety apparatus for an escalator and an escalator comprising such safety apparatus. A skirt brush, an illumination device and sensors are integrated into the safety apparatus, and the safety apparatus has a small volume, a simple structure and a low cost, and is safe and beautiful.

The present disclosure relates to a safety apparatus for an escalator, the safety apparatus is disposed on a skirt of the escalator along a length of the skirt, and is characterized in that, the safety apparatus comprises a one-piece profile which comprises, along a length of the profile, a rear wall, an upper portion at an upper end of the rear wall and extending toward a step side, and a lower portion at a lower end of the rear wall and extending toward the step side, wherein a plurality of sensor holes are provided on the rear wall; and the safety apparatus further comprises an illumination device, a skirt brush, and a plurality of photoelectric sensors, wherein the illumination device is disposed on the profile and emits illumination light toward the step side, wherein the skirt brush is disposed on the lower portion of the profile along the length of the profile, and wherein the plurality of photoelectric sensors are mounted to be respectively aligned with the plurality of sensor holes on the rear wall so as to emit and/or receive optical signals through the plurality of sensor holes.

For example, in a movement direction of the escalator, the profile comprises an upper horizontal section, an inclined section, a lower horizontal section, an upper curved section disposed between the upper horizontal section and the inclined section, and a lower curved section disposed between the inclined section and the lower horizontal section.

For example, a plurality of mounting holes are provided on a rear wall of the upper curved section and a rear wall of the lower curved section, and the safety apparatus is mounted on the skirt at the upper curved section and the lower curved section by providing screws in the plurality of mounting holes.

For example, a closed upper cavity is formed by the upper portions and the rear walls of the upper curved section and the lower curved section, and a closed lower cavity is formed by the lower portions and the rear walls of the upper curved section and the lower curved section.

For example, an open upper mounting cavity is formed by the upper portions and the rear walls of the upper horizontal section, the inclined section and the lower horizontal section, and an open lower mounting cavity is formed by the lower portions and the rear walls of the upper horizontal section, the inclined section and the lower horizontal section.

For example, the safety apparatus is mounted on the skirt by providing sunk screws in the open upper mounting cavity and lower mounting cavity at the upper horizontal section, the lower horizontal section and the inclined section.

For example, the safety apparatus further comprises a light-transmissive cover, wherein the light-transmissive cover is disposed at ends on the step side of the upper portion and the lower portion along the length of the profile.

For example, the upper portion comprises an upper protrusion at the end thereof on the step side, and the lower portion comprises a lower protrusion at the end thereof on the step side, wherein the light-transmissive cover is snapped onto the profile by the upper protrusion and the lower protrusion.

For example, the upper portion of the profile is provided with a first groove, and the illumination device is disposed in the first groove.

For example, the first groove is inclined such that the illumination device emits illumination light obliquely toward the step side.

For example, the lower portion of the profile is provided with a first groove, and the illumination device is disposed in the first groove.

For example, the lower portion of the profile is provided with a second groove, and the skirt brush is disposed in the second groove.

For example, the plurality of sensor holes are uniformly distributed along the length of the profile.

For example, the illumination device is an LED light strip that extends along the length of the profile.

For example, the illumination device is a plurality of LED lamps uniformly distributed along the length of the profile.

The present disclosure also relates to an escalator comprising steps and two skirts on two sides of the steps, which is characterized in that, the escalator further comprises the safety apparatus as described above, wherein the safety apparatus is disposed on at least one of the skirts.

BRIEF DESCRIPTION OF THE DRAWINGS

Features and advantages of the present disclosure will become more apparent from following detailed description of embodiments of the present disclosure with reference to attached drawings. In order to better show the relationship between the components in the drawings, the drawings are not drawn to scale. In the figures.

DETAILED DESCRIPTION

Figure 1:
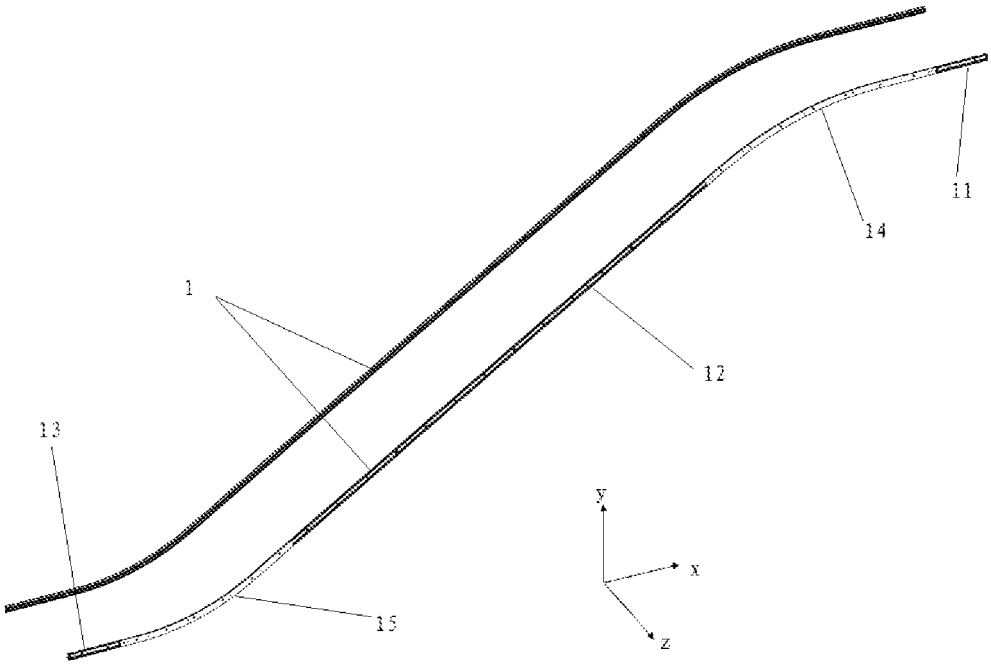
FIG. 1 is an overall schematic view of a profile of one embodiment of a safety apparatus of the present disclosure.

Various exemplary embodiments of the present disclosure will be described in detail with reference to the accompanying drawings. Here, it should be noted that, in the drawings, the same reference numerals are given to components having substantially the same or similar structures and functions, and repeated descriptions thereof will be omitted. Unless otherwise specified, the terms "movement direction", "height direction", "width direction", and the like herein are all described with respect to the drawings of the present disclosure. The terms "front", "rear", "up" and "down" are merely used to describe the relative positions of the components, and do not limit the scope of the present disclosure. Without departing from the scope of the present disclosure, the "front" may be "back", and "up" may be "down". The description of "first" and its variants is only for distinguishing the components, and does not limit the scope of the present disclosure. Without departing from the scope of the present disclosure, "first component" can be written as "second component", etc.

The drawings of the description are illustrative and used to describe the concept of the present disclosure. The drawings show the shape and relationship of the various components.

Hereafter, embodiments of the present disclosure are described with reference to FIG. 1 to FIG. 8.

FIG. 1 shows a one-piece profile 1 of a safety apparatus for an escalator of the present disclosure. The safety device is disposed on the skirt of the escalator along the length of the skirt. As illustrated in FIG. 1, the movement direction of the escalator is basically the left-to-right direction x in the figure, the height direction of the escalator is the bottom-to-top direction y, and the width direction of the escalator is the direction z perpendicular to the movement direction and the height direction. Steps (not shown) of the escalator are arranged between two skirts of the escalator along the width direction z.

In addition, the one-piece profile 1 in FIG. 1 is disposed along the length of the skirt, and in the movement direction x of the escalator, the profile 1 comprises an upper horizontal section 11, an inclined section 12, a lower horizontal section 13, an upper curved section 14 disposed between the upper horizontal section and the inclined, and a lower curved section 15 disposed between the inclined section and the lower horizontal section. In other embodiments of the present disclosure, the profile 1 of the safety apparatus may comprise only the upper horizontal section 11, the inclined section 12 and the lower horizontal section 13.

Figure 2:
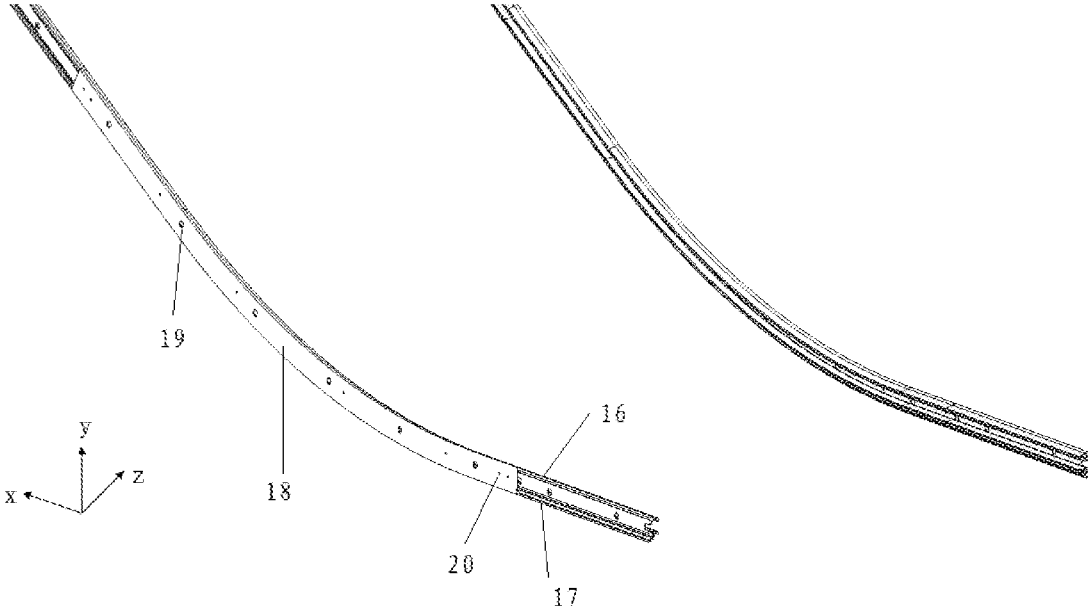
FIG. 2 is a partial schematic view of a profile of one embodiment of the safety apparatus of the present disclosure, which shows a lower curved section, a part of a lower horizontal section and a part of an inclined section of the profile.

FIG. 2 shows a partial schematic view of the profile of the safety apparatus of the present disclosure. The bottom-to-top direction y in FIG. 2 is the height direction of the escalator, the direction x is the movement direction of the escalator, and the direction z is the width direction of the escalator. The steps of the escalator are provided along the width direction z. As shown in FIG. 2, along the length of the profile 1, the profile 1 comprises a rear wall 18, an upper portion 16 at the upper end of the rear wall and extending toward the step side, and a lower portion 17 at the lower end of the rear wall and extending toward the step side. "Upper" and "lower" in this description are described with respect to the position in the height direction of the escalator, but the present disclosure is not limited thereto. A plurality of sensor holes 19 are provided on the rear wall 18 along the length of the profile 1. As shown in FIG. 2, the rear wall 18 of the lower curved section of the profile 1 comprises a plurality of mounting holes 20. As the same as the lower curved section, the rear wall of the upper curved section also comprises a plurality of mounting holes.

For example, the safety apparatus is mounted on the skirt along the length of the skirt by screws passing through the plurality of mounting holes 20 and corresponding holes on the skirt.

For example, the plurality of sensor holes 19 are uniformly distributed along the length of the profile. Of course, the sensor holes of the present disclosure may also be unevenly distributed on the rear wall of the profile.

Figure 3:
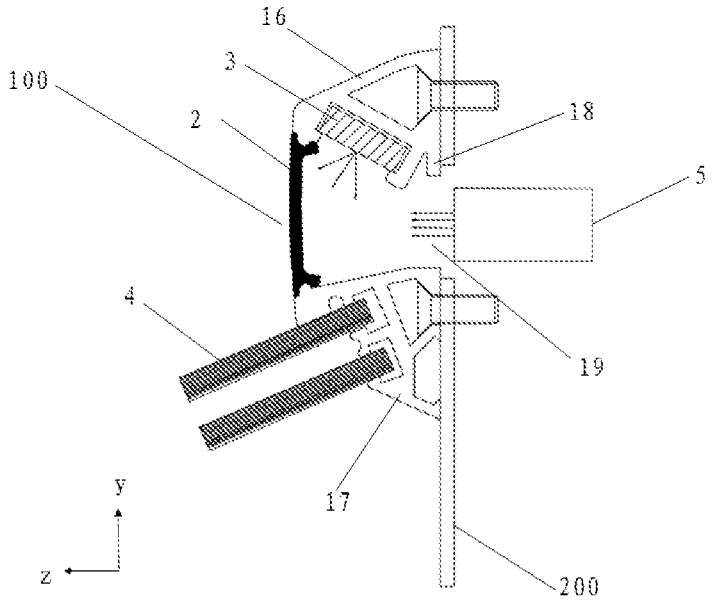
FIG. 3 is a sectional view of one embodiment of the safety apparatus of the present disclosure.

FIG. 3 shows a sectional view of one embodiment of the safety apparatus 100. The right-to-left direction z shown in FIG. 3 is the width direction of the escalator, and the bottom-to-top direction y is the height direction of the escalator. The steps of the escalator are provided along the width direction z. As shown in FIG. 3, the safety apparatus 100 further comprises a light-transmissive cover 2, an illumination device 3, a skirt brush 4, and a plurality of photoelectric sensors 5. The light-transmissive cover 2 may be, for example, a transparent or translucent cover.

In other embodiments of the present disclosure, the safety apparatus may not comprise the light-transmissive cover, or the illumination device itself may comprise a light-transmissive cover.

As shown in FIGS. 1 and 3, the light-transmissive cover 2 is disposed at the ends on the step side of the upper portion 16 and the lower portion 17 along the length of the profile 1. The illumination device 3 is arranged on the upper portion 16 of the profile 1 and emits illumination light towards the step side. The illumination device may also be arranged in other parts of the profile. As shown in FIGS. 1 and 3, the skirt brush 4 is arranged on the lower portion 17 of the profile along the length of the profile 1. As shown in FIGS. 2 to 3, each photoelectric sensor 5 is aligned with each sensor hole 19 on the rear wall 18 to emit and/or receive optical signals through each sensor hole.

For example, the photoelectric sensor 5 can be mounted on the rear wall 18 of the profile 1.

As shown in FIG. 2, the plurality of sensor holes 19 are uniformly distributed along the length of the profile, so that the plurality of photoelectric sensors 5 can be uniformly distributed along the length of the profile, but the present disclosure is not limited thereto, and the sensor distribution may be non-uniform.

During the maintenance of the escalator, the photoelectric sensors 5 ensure that the escalator is always in a disabled state, which will not cause accidental injury to people and improve the safety of the escalator.

Figure 4:
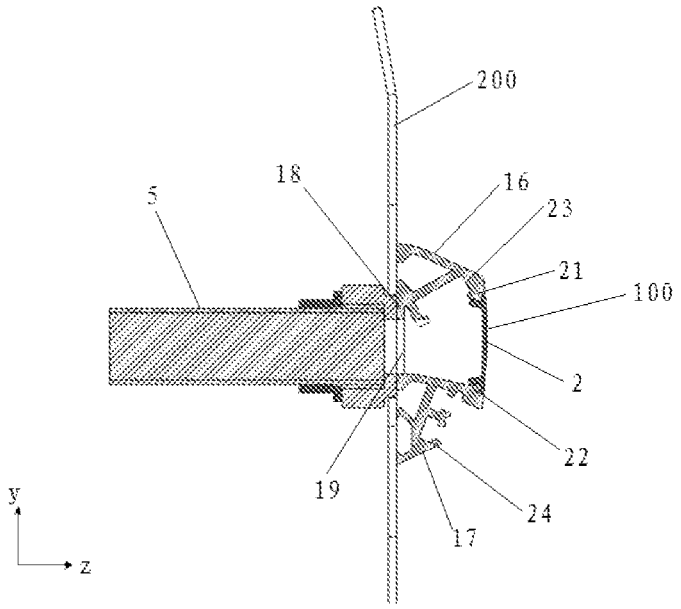
FIG. 4 is a sectional view of one embodiment of the safety apparatus of the present disclosure, in which the sensor is mounted through a bracket to align with the sensor hole of the profile.

FIG. 4 is a sectional view of one embodiment of the safety apparatus 100 of the present disclosure.

As shown in FIG. 4, in the width direction z of the escalator, the upper portion 16 comprises an upper protrusion 21 at its end on the step side (i.e., at its end remote from the skirt 200), and the lower portion comprises a lower protrusion 22 at its end on the step side (i.e., at its end remote from the skirt 200), wherein the light-transmissive cover 2 is snapped onto the profile 1 by means of the upper protrusion 21 and the lower protrusion 22. The light-transmissive cover can also be mounted on the profile by screws or bonded to the profile, and the installation manner of the light-transmissive cover of the present disclosure is not limited to the above embodiments.

For example, the profile 1 shown in FIG. 4 is mounted on one side of the skirt 200, the photoelectric sensor 5 is aligned with the sensor hole 19 on the rear wall 18 and the corresponding hole on the skirt 200, and is mounted on the other side of the skirt by a bracket fixed to the skirt 200.

The upper portion 16 of the profile may be provided with a first groove 23, and the illumination device 3 is disposed in the first groove 23. The first groove 23 may be set to be parallel to the skirt 200. Of course, the first groove 23 may also be provided in the lower portion 17 of the profile. For example, as shown in FIGS. 3 and 4, the first groove 23 is inclined with respect to the width direction z of the escalator, so that the illumination device 3 is disposed obliquely in the profile 1 and emits the illumination light toward the step side. In this way, the safety apparatus can be compact and occupy a smaller volume.

For example, the illumination device 3 shown in FIGS. 3 and 4 is an LED light strip extending along the length of the profile 1. Alternatively, the illumination device may be a plurality of LED lamps, which are uniformly distributed along the length of the profile.

The lower portion 17 of the profile may be provided with a second groove 24 in which the skirt brush 4 is arranged. As shown in FIGS. 3 and 4, the profile 1 comprises two second grooves 24. According to actual needs, the profile may comprise only one second groove 24. The number of skirt brushes in the safety apparatus of the present disclosure is not limited to the embodiments described herein.

The skirt device, the illumination device and the sensors are integrated in the safety apparatus of the present disclosure, so the volume is small, the structure is simple, the cost is low, and the apparatus is safe and beautiful.

Figure 5:
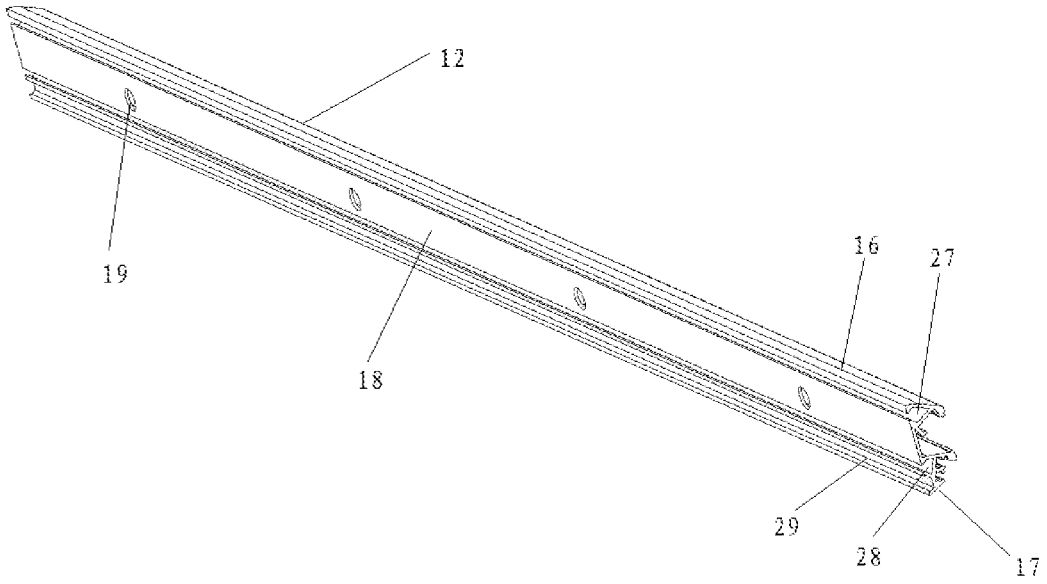
FIG. 5 is a partially enlarged schematic diagram of the inclined section of the profile shown in FIG. 2.
Figure 6:
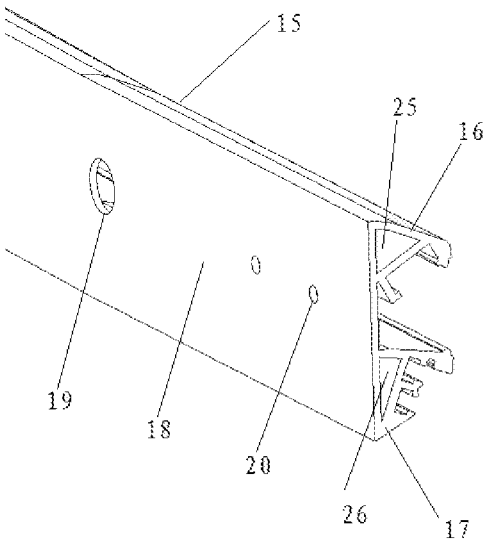
FIG. 6 is a partially enlarged schematic diagram of the lower curved section of the profile shown in FIG. 2.
Figure 7:
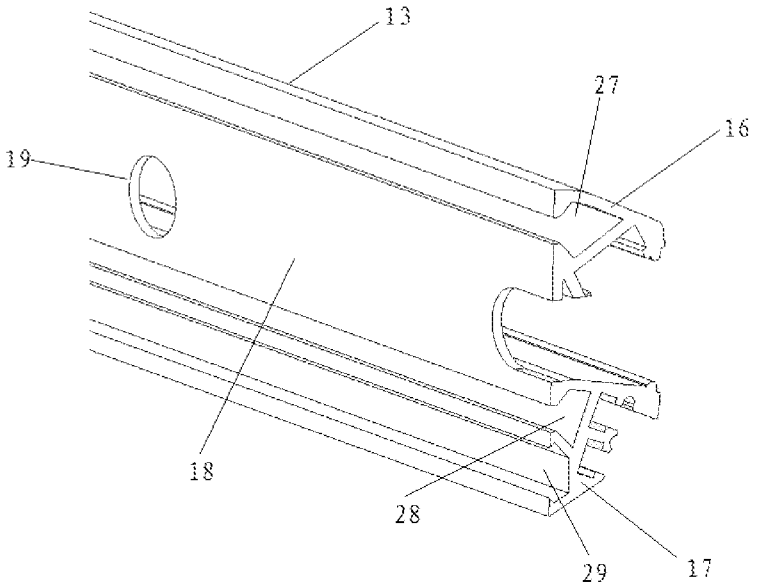
FIG. 7 is a partially enlarged schematic diagram of the lower horizontal section of the profile shown in FIG. 2.

FIG. 2 shows the lower curved section, a part of the lower horizontal section and a part of the inclined section of the profile; FIG. 5 shows an enlarged schematic view of a part of the inclined section of the profile shown in FIG. 2; FIG. 6 shows an enlarged schematic view of a part of the lower curved section of the profile shown in FIG. 2; and FIG. 7 shows an enlarged schematic view of a part of the lower horizontal section of the profile shown in FIG. 2. The rear wall 18 together with the upper portion 16 and the lower portion 17 of the lower curved section 15 in FIG. 6 form a closed upper cavity 25 and a closed lower cavity 26, respectively. Like the lower curved section 15, the upper curved section 14 also has a closed upper cavity 25 and a closed lower cavity 26 formed by the rear wall 18 together with the upper portion 16 and the lower portion 17, respectively. As shown in FIG. 5 and FIG. 7, the rear wall 18 and the upper section 16 of the inclined section 12 and the lower horizontal section 13 form an open upper mounting cavity 27, and the rear wall 18 and the lower section 17 of the inclined section 12 and the lower horizontal section 13 form an open lower mounting cavity 28. For example, at the upper curved section and the lower curved section, the safety apparatus is mounted on the skirt by providing screws in a plurality of mounting holes 20. For example, at the upper horizontal section, the lower horizontal section and the inclined section, the safety apparatus is mounted on the skirt 200 by providing sunk screws in the open upper mounting cavity 27 and the open lower mounting cavity 28, as shown in the sectional views of FIGS. 3 and 4. As shown in FIGS. 5 and 7, the rear wall 18 of the upper horizontal section, the lower horizontal section and the inclined section may not comprise mounting holes.

The present disclosure can freely set the position of the sunk screws through the open mounting cavity formed along the length of the profile, and it is not necessary to manufacture precisely aligned mounting holes in the profile and the skirt, thereby improving the installation freedom of the safety apparatus and reducing processing accuracy requirements for safety apparatus and skirts.

In addition, as shown in FIGS. 5 and 7, in order to facilitate molding, the upper horizontal section, the lower horizontal section and the inclined section of the profile 1 may further comprise a process cavity 29 located below the lower mounting cavity 28.

In other embodiments of the present disclosure, the upper horizontal section, the lower horizontal section, and the inclined section of the profile may also comprise a closed upper cavity and a closed lower cavity, and the profile is mounted on the skirt through mounting holes with screws.

Figure 8:
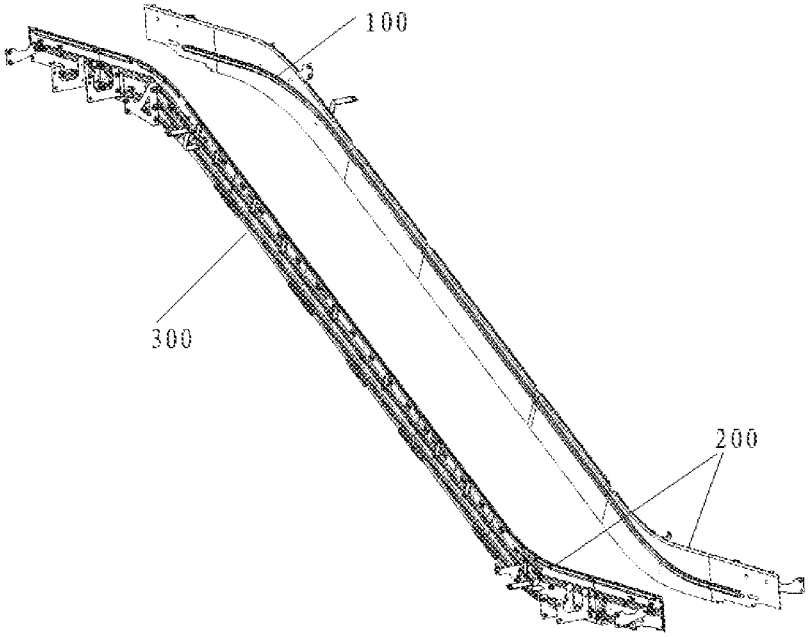
FIG. 8 is a schematic diagram of an escalator of the present disclosure, which shows the safety apparatus of the present disclosure being provided on the skirt of the escalator.

FIG. 8 shows a schematic diagram of one embodiment of an escalator 300 according to the present disclosure. The escalator 300 includes steps (not shown in FIG. 8) and two skirts 200 located on both sides of the steps. The safety apparatus 100 of the present disclosure is disposed on two skirts 200 of the escalator 300 shown in FIG. 8. According to the actual situation, the safety apparatus 100 of the present disclosure may be disposed on only one skirt 200 of the escalator 300.

For example, the photoelectric sensor 5 may be an active infrared sensor, which comprises a transmitting system and a receiving system, wherein the transmitting system emits an infrared beam in the width direction of the escalator, and the infrared beam is received by the receiving system located on the skirt on the other side of the escalator. Therefore an infrared beam warning line is formed. When an obstacle exists in the path of the infrared beam, the infrared beam is blocked, and the sensor detects that a person or an object enters the escalator, thereby keeping the escalator in a disabled state. At this time, the safety apparatuses comprising such an active infrared sensor are provided on two skirts of the escalator.

Alternatively, the photoelectric sensor 5 may be, for example, a passive infrared sensor that senses infrared radiation of a human body. When someone enters the escalator in the disabled state, the infrared sensor detects the infrared radiation of the human body, and then the escalator is kept in the disabled state. At this time, the safety apparatus comprising such a passive infrared sensor may be provided on only one skirt of the escalator, or on two skirts of the escalator.

Of course, the photoelectric sensor of the present disclosure is not limited to the above two cases, and the photoelectric sensor of the present disclosure may also be a sensor that emits visible light.

The technical features disclosed above are not limited to the disclosed combinations with other features, and those skilled in the art may also perform other combinations between the technical features according to the purpose of the present disclosure, in order to achieve the purpose of the present disclosure.

What is claimed is:

1. A safety apparatus for an escalator, the safety apparatus being disposed on a skirt of the escalator along a length of the skirt, the safety apparatus comprising:

a one-piece profile which comprises, along a length of the profile, a rear wall, an upper portion at an upper end of the rear wall and extending toward a step side, and a lower portion at a lower end of the rear wall and extending toward the step side, wherein a plurality of sensor holes are provided on the rear wall;

an illumination device;

a skirt brush; and a plurality of photoelectric sensors, wherein the illumination device is disposed on the profile and emits illumination light toward the step side, wherein the skirt brush is disposed on the lower portion of the profile along the length of the profile, wherein the plurality of photoelectric sensors are mounted to be respectively aligned with the plurality of sensor holes on the rear wall so as to emit and/or receive optical signals through the plurality of sensor holes, wherein in a movement direction of the escalator, the profile comprises an upper horizontal section, an inclined section, a lower horizontal section, an upper curved section disposed between the upper horizontal section and the inclined section, and a lower curved section disposed between the inclined section and the lower horizontal section, and wherein a closed upper cavity is formed by the upper portions and the rear walls of the upper curved section and the lower curved section, and a closed lower cavity is formed by the lower portions and the rear walls of the upper curved section and the lower curved section.

2. The safety apparatus according to claim 1, wherein, a plurality of mounting holes are provided on a rear wall of the upper curved section and a rear wall of the lower curved section, and the safety apparatus is mounted on the skirt at the upper curved section and the lower curved section by providing screws in the plurality of mounting holes.

3. The safety apparatus according to claim 2, wherein, a closed upper cavity is formed by the upper portions and the rear walls of the upper curved section and the lower curved section, and a closed lower cavity is formed by the lower portions and the rear walls of the upper curved section and the lower curved section.

4. The safety apparatus according to claim 1, wherein, an open upper mounting cavity is formed by the upper portions and the rear walls of the upper horizontal section, the inclined section and the lower horizontal section, and an open lower mounting cavity is formed by the lower portions and the rear walls of the upper horizontal section, the inclined section and the lower horizontal section.

5. The safety apparatus according to claim 4, wherein, the safety apparatus is mounted on the skirt by providing sunk screws in the open upper mounting cavity and the lower mounting cavity at the upper horizontal section, the lower horizontal section and the inclined section.

6. The safety apparatus according to claim 1, wherein, the safety apparatus further comprises a light-transmissive cover, wherein the light-transmissive cover is disposed at ends on the step side of the upper portion and the lower portion along the length of the profile.

7. The safety apparatus according to claim 6, wherein, the upper portion comprises an upper protrusion at the end thereof on the step side, and the lower portion comprises a lower protrusion at the end thereof on the step side, wherein the light-transmissive cover is snapped onto the profile by the upper protrusion and the lower protrusion.

8. The safety apparatus according to claim 1, wherein, the upper portion of the profile is provided with a first groove, and the illumination device is disposed in the first groove.

9. The safety apparatus according to claim 8, wherein, the first groove is inclined such that the illumination device emits illumination light obliquely toward the step side.

10. The safety apparatus according to claim 1, wherein, the lower portion of the profile is provided with a first groove, and the illumination device is disposed in the first groove.

11. The safety apparatus according to claim 1, wherein, the lower portion of the profile is provided with a second groove, and the skirt brush is disposed in the second groove.

12. The safety apparatus according to claim 1, wherein, the plurality of sensor holes are uniformly distributed along the length of the profile.

13. The safety apparatus according to claim 1, wherein, the illumination device is an LED light strip that extends along the length of the profile.

14. The safety apparatus according to claim 1, wherein, the illumination device is a plurality of LED lamps uniformly distributed along the length of the profile.

15. An escalator comprising steps and two skirts on two sides of the steps, wherein, the escalator further comprises the safety apparatus according to claim 1, wherein the safety apparatus is disposed on at least one of the skirts.

* * * * *